US006887101B2

(12) United States Patent
Ito et al.

(10) Patent No.: US 6,887,101 B2
(45) Date of Patent: May 3, 2005

(54) DIFFERENTIAL TRANSMISSION CONNECTOR

(75) Inventors: Takeshi Ito, Shinagawa (JP); Mitsuru Kobayashi, Shinagawa (JP); Hideo Miyazawa, Shinagawa (JP); Noboru Shimizu, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/832,347

(22) Filed: Apr. 27, 2004

(65) Prior Publication Data

US 2004/0242066 A1 Dec. 2, 2004

(30) Foreign Application Priority Data

May 28, 2003 (JP) ..... 2003-150600

(51) Int. Cl.[7] ..... H01R 33/945
(52) U.S. Cl. ..... 439/577
(58) Field of Search ..... 439/577, 607–608, 439/620, 82–83; 385/75–77

(56) References Cited

U.S. PATENT DOCUMENTS 6,448,863 B1 * 9/2002 Ogawa et al. ..... 333/12
6,478,625 B2 * 11/2002 Tolmie et al. ..... 439/608
2002/0115342 A1 * 8/2002 Stricot et al. ..... 439/577
2004/0018757 A1 * 1/2004 Lang et al. ..... 439/82

FOREIGN PATENT DOCUMENTS

JP 2003-059593 2/2003
JP 2004071231 A * 3/2004 ..... H01R/13/658

* cited by examiner

*Primary Examiner*—Michael C. Zarroli
(74) *Attorney, Agent, or Firm*—Staas & Halsey LLP

(57) ABSTRACT

A connector for differential transmission is disclosed. The connector includes a connector housing, a connector main body attached thereto, and a photoelectric conversion module provided to the connector housing to be electrically connected to the connector main body. The connector main body includes a differential transmission electric connector part connectable to the connector of an apparatus. Ground contact members and signal contact pairs each including first and second signal contact members are arranged alternately in the connector main body. The photoelectric conversion module includes a photoelectric conversion part and an optical fiber cable connector part to which an optical fiber cable is connectable. The differential transmission electric connector part and the optical fiber cable connector part are provided to the opposite ends of the connector housing.

7 Claims, 15 Drawing Sheets

DIFFERENTIAL TRANSMISSION CONNECTOR

BACKGROUND OF THE INVENTION

1. Field of the Invention

The present invention relates generally to connectors for differential transmission, and more particularly to a connector for differential transmission employed for connection to computer apparatuses.

2. Description of the Related Art

Differential transmission has been employed in many cases as a method of transmitting data between personal computers and peripheral devices. Differential transmission uses a pair of lines for each data element, and simultaneously transmits a "+" signal to be transmitted and a "−" signal equal in magnitude and opposite in direction to the "+" signal. Differential transmission has the advantage of being less susceptible to noise compared with a normal transmission method.

When the distance between a server apparatus and a computer apparatus is short, the server apparatus and the computer apparatus may be connected satisfactorily with an electric wire cable. However, if the server apparatus and the computer apparatus are remote from each other, it is desirable to substitute an optical fiber cable for the electric wire cable in view of the reliability of signal transmission.

FIG. 1 is a diagram showing a conventional cable-type plug connector for differential transmission 10 employed to connect computer apparatuses. The differential transmission plug connector 10 includes a connector main body 11, a housing 12, and a plug part for differential transmission 13. The connector main body 11 is incorporated in the housing 12 on its front end side. The plug part 13 projects from the housing 12 at the front end thereof. An electric wire cable 14 extends from the rear end of the housing 12.

Japanese Laid-Open Patent Application No. 2003-059593 discloses a conventional cable-type connector for differential transmission.

Conventionally, the plug connector of FIG. 1 is the only type of cable-type plug connector for differential transmission employed to connect computer apparatuses. Accordingly, a conventional server apparatus 20 has a jack connector for differential transmission 21 and an optical fiber connector 22 provided on its rear side, and has a built-in photoelectric conversion module 23 electrically connected to the optical fiber connector 22 as shown in FIG. 2.

When the server apparatus 20 is located a short distance from a computer, the server apparatus 20 is connected to the computer with the electric wire cable 14, using the plug connector 10. When the server apparatus 20 is located remote from the computer so that there is a long distance between the server apparatus 20 and the computer, an optical fiber connector 30 is connected to the optical fiber connector 22 so that the server apparatus 20 and the computer are connected with an optical fiber cable 31 so as to prevent the degradation of signal quality.

Thus, the server apparatus 20, which has two types of connectors, that is, the differential transmission jack connector 21 and the optical fiber connector 22, provided on its rear side and has the photoelectric conversion module 23 provided inside, is costly. In particular, the optical fiber connector 22 and the photoelectric conversion module 23 are unnecessary to users who use the server apparatus 20 at a location close to the computer, thus making the server apparatus 20 costly for the users.

SUMMARY OF THE INVENTION

Accordingly, it is a general object of the present invention to provide a connector for differential transmission in which the above-described disadvantage is eliminated.

A more specific object of the present invention is to provide a connector for differential transmission that allows server apparatuses to have simpler structures.

The above objects of the present invention are achieved by a connector for differential transmission, including: a connector housing; a connector main body attached to the connector housing, the connector main body including a differential transmission electric connector part connectable to a connector of an apparatus, the differential transmission electric connector part having a plurality of signal contact pairs and a plurality of ground contact members arranged alternately, the signal contact pairs each including first and second signal contact members; and a photoelectric conversion module provided to the connector housing to be electrically connected to the connector main body, the photoelectric conversion module including a photoelectric conversion part and an optical fiber cable connector part to which an optical fiber cable is connectable, wherein the differential transmission electric connector part of the connector main body is provided to the connector housing on a side of a first end thereof, and the optical fiber cable connector part of the photoelectric conversion module is provided to the connector housing on a side of a second end thereof, the second end being opposite to the first end.

The above-described connector may be used, being electrically connected to a differential transmission connector, so that differential electrical signals may be converted into light signals and transmitted. The above-described connector allows an apparatus to dispense with an optical connector, so that the apparatus is reduced in production cost.

The above objects of the present invention is also achieved by a connector for differential transmission, including: a connector housing; a connector main body provided to the connector housing, the connector main body including a differential transmission electric connector part connectable to a connector of an apparatus, the differential transmission electric connector part having a plurality of signal contact pairs and a plurality of ground contact members arranged alternately, the signal contact pairs each including first and second signal contact members; a rigid printed circuit board provided to the connector housing; and a photoelectric conversion module provided to the connector housing, being mounted on the rigid printed circuit board to be electrically connected to the connector main body, the photoelectric conversion module including a photoelectric conversion part and an optical fiber cable connector part to which an optical fiber cable is connectable, wherein the differential transmission electric connector part of the connector main body is provided to the connector housing on a side of a first end thereof, and the optical fiber cable connector part of the photoelectric conversion module is provided to the connector housing on a side of a second end thereof, the second end being opposite to the first end.

The above-described connector may be used, being electrically connected to a differential transmission connector, so that differential electrical signals may be converted into light signals and transmitted. The above-described connector allows an apparatus to dispense with an optical connector, so that the apparatus is reduced in production cost. Further, the above-described connector has a photoelectric conversion part mounted on a rigid printed circuit board. Accordingly, it is easy to incorporate the photoelectric conversion part in the connector and to electrically connect a connector main body and the photoelectric conversion part.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
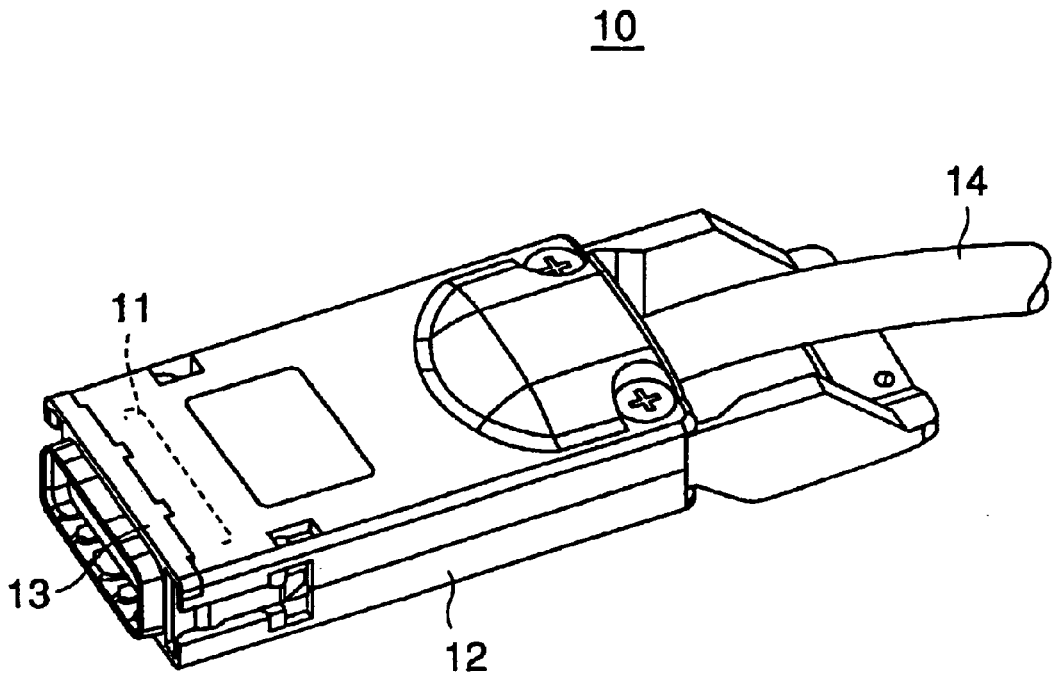
FIG.1 PRIOR ART
FIG. 1 is a perspective view of a conventional plug connector for differential transmission.

A description is given below, with reference to the accompanying drawings, of embodiments of the present invention.

In the drawings, $X_1$–$X_2$, $Y_1$–$Y_2$, and $Z_1$–$Z_2$ indicate the directions of width, length, and height, respectively, of a plug connector.

Figure 3:
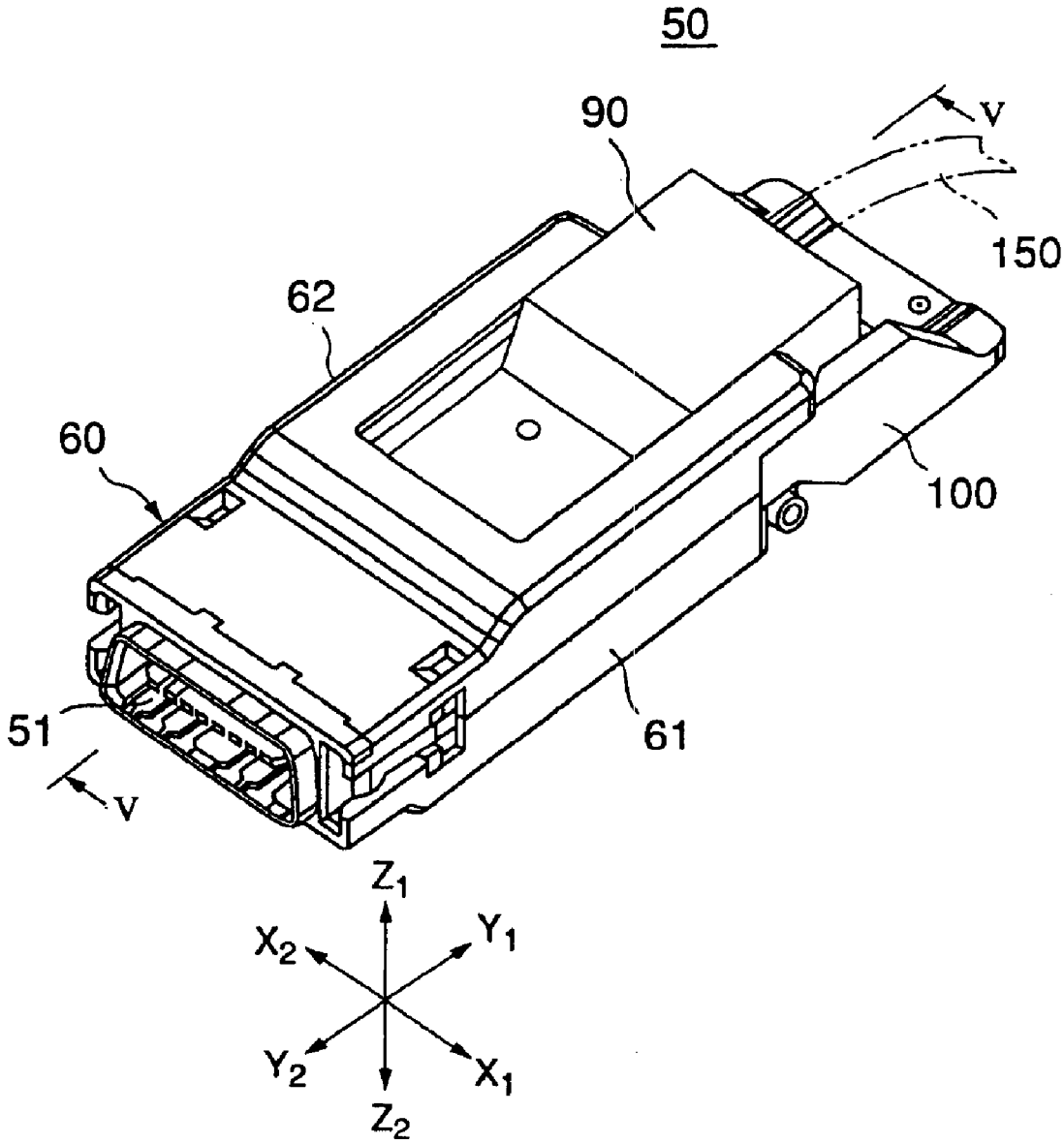
FIG. 3 is a perspective view of a plug connector for differential transmission in an upside down position according to a first embodiment of the present invention.
Figure 4:
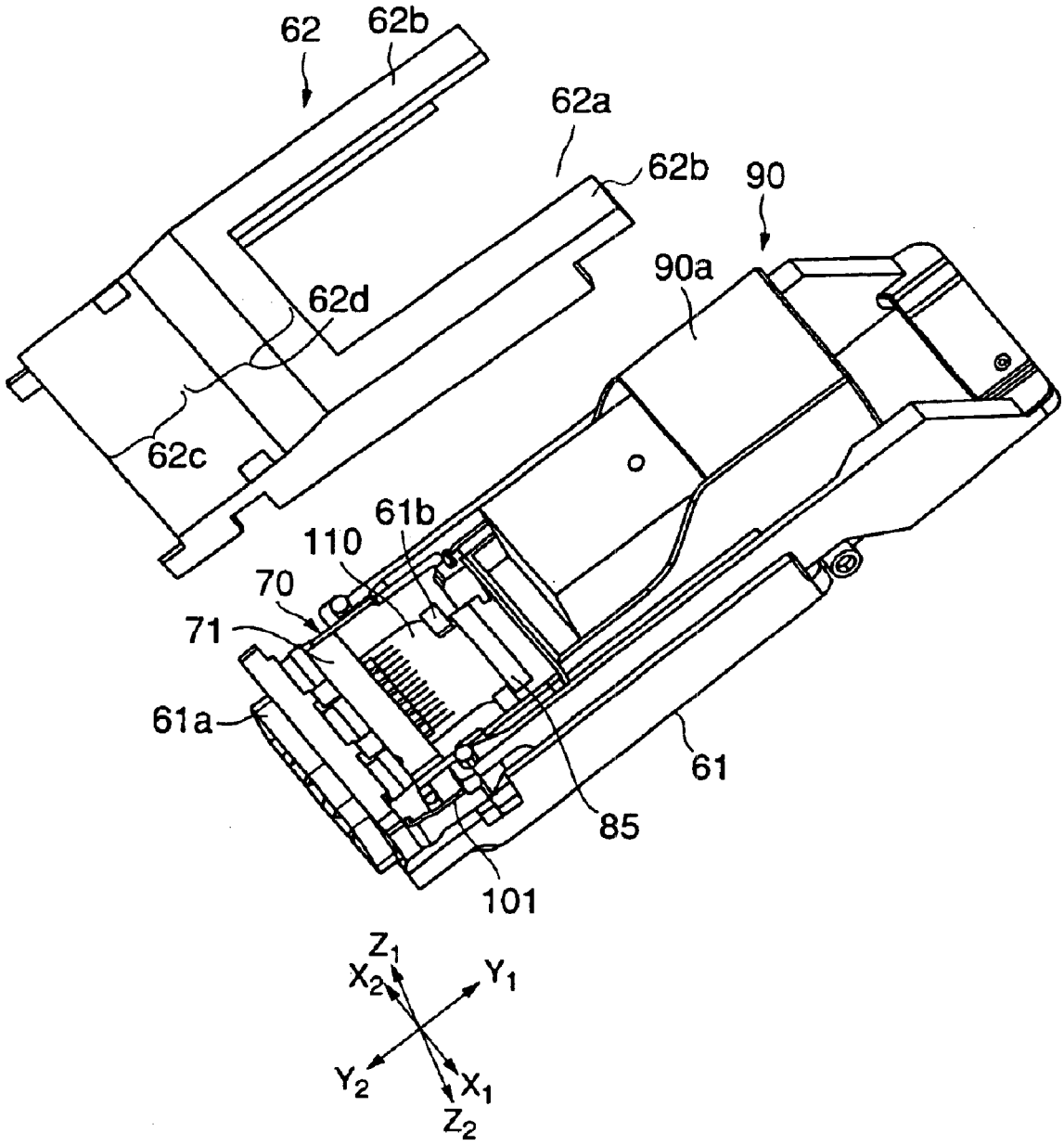
FIG. 4 is a partially exploded view of the plug connector of FIG. 3 according to the first embodiment of the present invention.
Figure 5:
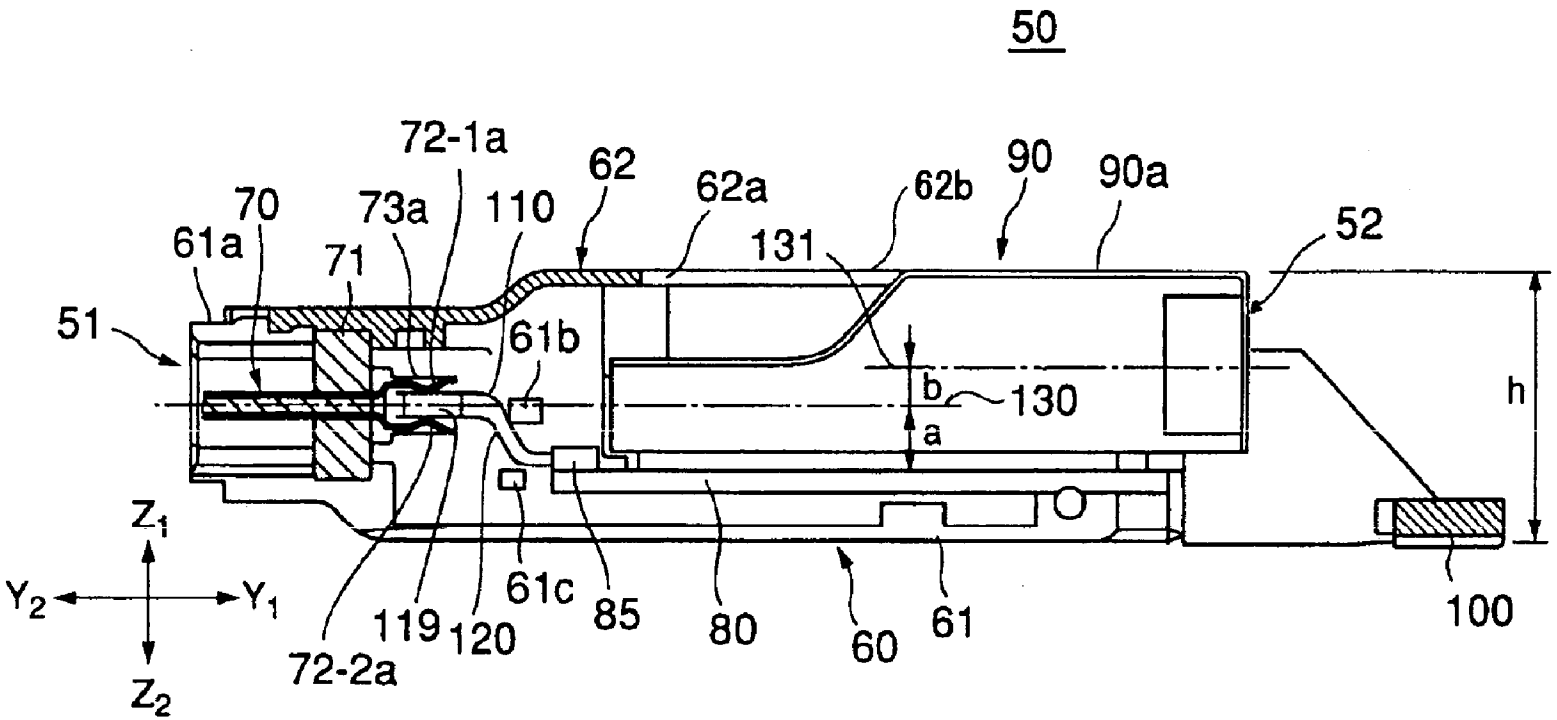
FIG. 5 is a sectional view of the plug connector of FIG. 3 taken along the line V—V according to the first embodiment of the present invention.

FIGS. 3, 4, and 5 are diagrams showing a cable-type plug connector for differential transmission 50 according to a first embodiment of the present invention. In FIGS. 3, 4, and 5, the connector 50 is shown bottom side up for convenience of graphical representation. In the following description, the words "upper" and "lower" are used based on the positions of the connector 50 shown in the drawings. The connector 50 includes a housing 60, a differential transmission plug connector main body 70, and a photoelectric conversion module 90. The connector main body 70 and the module 90 are incorporated in the housing 60. The connector 50 is substantially equal in size, particularly, in height, to the conventional connector 10 of FIG. 1 (the connector 50 has a height h as shown in FIG. 5).

Referring to FIGS. 3 through 5, the connector 50 is configured so that the connector main body 70, a rigid printed circuit board 80, and the photoelectric conversion module 90 are incorporated in the housing 60 and a pull tab 100 is provided to project in the $Y_1$ direction from the housing 60. The connector main body 70 is disposed on the $Y_2$ side, the photoelectric conversion module 90 is disposed on the $Y_1$ side, and the printed circuit board 80 is disposed on the $Y_1$ side on the $Z_2$ side in the housing 60. The photoelectric conversion module 90 is mounted on the printed circuit board 80. The connector 50 has a differential transmission electric plug part 51 (a differential transmission electric connector part) at its $Y_2$-side end and an optical fiber cable connector part (an MPO connector) 52 at its $Y_1$-side end. An optical fiber cable 150 is connected to the optical fiber cable connector part 52. Reference numeral 130 denotes the center line of the connector 50 in the $Z_1$ and $Z_2$ directions, which passes through the center of the electric plug part 51. The printed circuit board 80 is biased (offset) in the $Z_2$ direction by a distance a relative to the center line 130 so that the electric plug part 51 is positioned vertically within the range of the height of the photoelectric conversion module 90. A distance by which a center line 131 of the optical fiber cable connector part 52 of the module 90 is biased (offset) in the $Z_1$ direction relative to the center line 130 is controlled to a small value b. As a result, the height h of the connector 50 is controlled to a small value, so that the connector 50 is substantially equal in height to the conventional connector 10 of FIG. 1.

The connector main body 70 and the printed circuit board 80 disposed with the distance (difference in level) a along the Z-axis are connected with flexible cables 110 and 120 so as to accommodate the distance a. A change in the distance a can be accommodated easily because of use of the flexible cables 110 and 120.

Next, a description is given of individual components of the connector 50.

The housing 60 is formed by combining lower and upper housing members 61 and 62 both of which are die castings. Latches 101 are provided on the $X_1$ and $X_2$ sides in the $Y_2$ end portion of the housing 60 so as to be positioned between the housing members 61 and 62. The pull tab 100 is incorporated in the housing 60 so as to be held between the housing members 61 and 62 on the $X_1$ and $X_2$ sides. The lower housing member 61 has a frame part 61*a* at its $Y_2$-side end.

The upper housing member 62 has a cutout window (a cutout window forming part) 62*a* on the $Y_1$ side. The photoelectric conversion module 90 is fitted to and exposed in the cutout window 62*a* so that a plane extending from parts 62*b* on both ($X_1$ and $X_2$) sides of the cutout window 62*a* coincides with an upper face 90*a* of the photoelectric conversion module 90. That is, the upper face 90*a* of the module 90 defines part of the outer form of the connector 50.

According to this configuration, the connector 50 is reduced in thickness (height) by the thickness of the upper plate of the upper housing member 62 compared with the configuration where the upper housing member 62 covers the upper face 90*a* of the photoelectric conversion module 90.

A $Y_2$-side part 62*c* of the upper housing member 62 covers the connector main body 70. A part 62*d* of the upper housing member 62 between the part 62*c* and the cutout window 62*a* covers the space above the flexible cables 110 and 120. Further, guide projections 61*b* and 61*c* that guide the flexible cables 110 and 120, respectively, to determine their respective forms of curvature are provided to the lower housing member 61.

Figure 6:
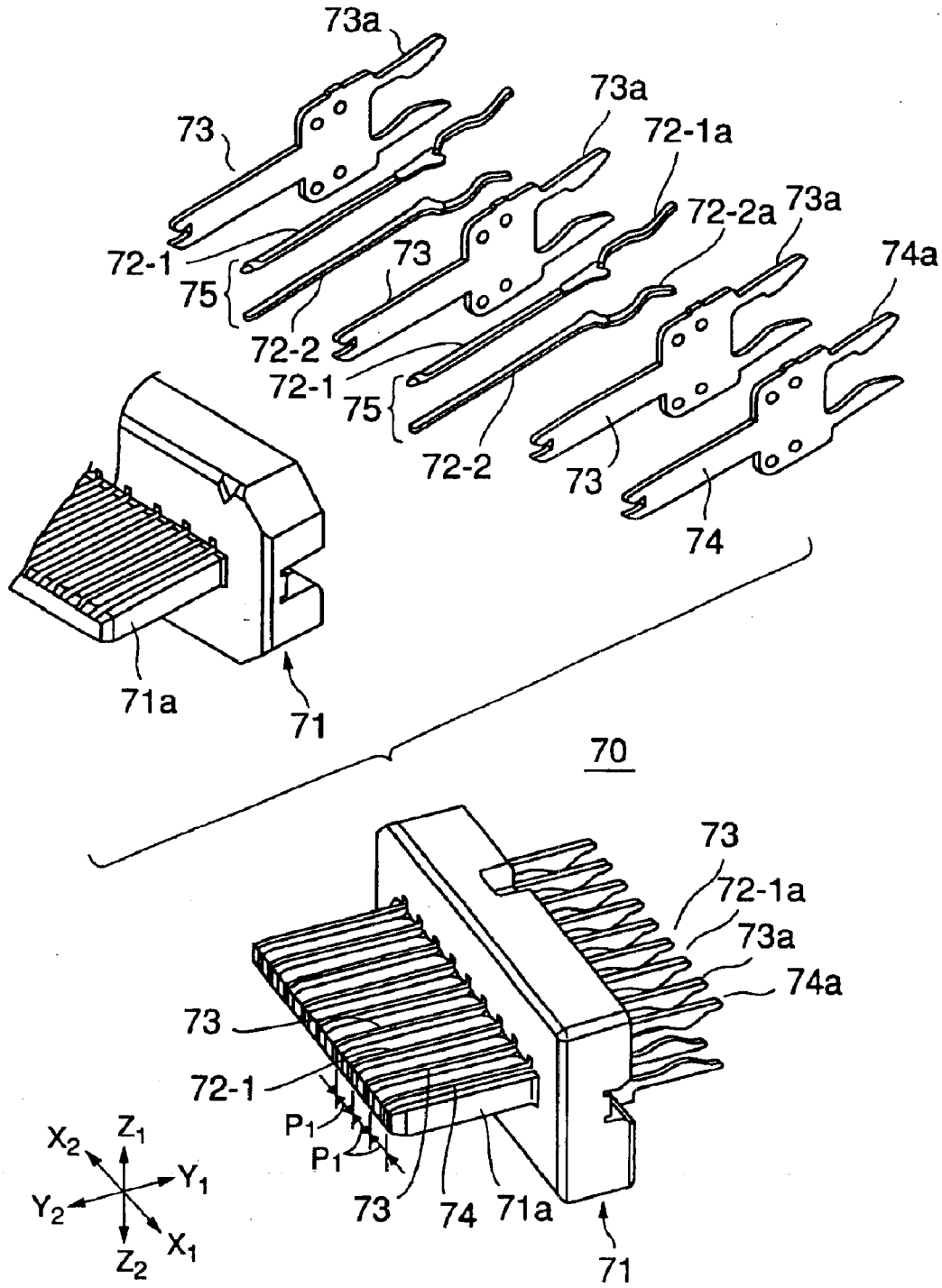
FIG. 6 is a schematic diagram showing a connector main body of the plug connector according to the first embodiment of the present invention.

FIG. 6 is a diagram showing the connector main body 70. Referring to FIG. 6, the connector main body 70, which is an electrically insulating molded component of a synthetic resin, includes a block body 71 having a plate-like projection part 71*a*. Signal contact pairs 75, each formed of first and second signal contact members 72-1 and 72-2, and plate-like ground contact members 73 are arranged alternately along the X-axis between plate-like power supply contact members 74, defining the $X_1$- and $X_2$-side ends of the arrangement, at predetermined pitches $P_1$ in the block body 71. The first and second signal contact members 72-1 and 72-2 forming each signal contact member 75 are exposed on the upper and lower faces, respectively, of the projection part 71*a*, and are located at the same position on the X-axis. The end faces of each ground contact member 73 are exposed on the upper and lower surfaces, respectively, of the projection part 71*a*. The adjacent signal contact pairs 75 along the X-axis are shielded from each other by the ground contact member 73 provided therebetween.

Each ground contact member 73 has a fork-like mounting terminal part 73*a*, and each first signal contact member 72-1 and each second signal contact member 72-2 have a mounting terminal part 72-1*a* and a mounting terminal part 72-2*a*, respectively. The mounting terminal parts 73*a*, 72-1*a*, and 72-2*a* project in the $Y_1$ direction from the block body 71. The mounting terminal parts 72-1*a* and 72-2*a* of the paired first and second signal contact members 72-1 and 72-1 oppose each other along the Z-axis, and are provided between the adjacent mounting terminal parts 73*a*.

Referring to FIG. 5, the connector main body 70 having the above-described structure is incorporated in the connector 50, being fixed immovably thereto, with the block body 71 being held between the lower and upper housing members 61 and 62. The projection part 71*a*, in which the first and second signal contact members 72-1 and 72-2 and the ground contact members 73 are incorporated, being arranged side by side, projects in the center of the frame part 61*a*.

The printed circuit board 80 is fixed to the lower housing member 61. A connector 85 for a flexible cable is mounted on the $Y_2$-side end of the upper surface of the printed circuit board 80. The printed circuit board 80 has the characteristic impedance of signal lines for differential signals set to 100 Ω.

The photoelectric conversion module 90, which has a substantially rectangular parallelepiped shape, includes an electrical signal processing part (not graphically represented), a light-emitting element part (not graphically represented) emitting light in accordance with an electrical signal processed by the electrical signal processing part, a light guide part (not graphically represented) guiding the light emitted from the light-emitting part to the optical fiber cable connector part 52, and a light-receiving element part (not graphically represented) converting a light signal transmitted from the light guide part into an electrical signal. The photoelectric conversion module 90 is supported on and fixed to the printed circuit board 80 with its bottom-side terminals being electrically connected to terminals on the printed circuit board 80.

Figure 7:
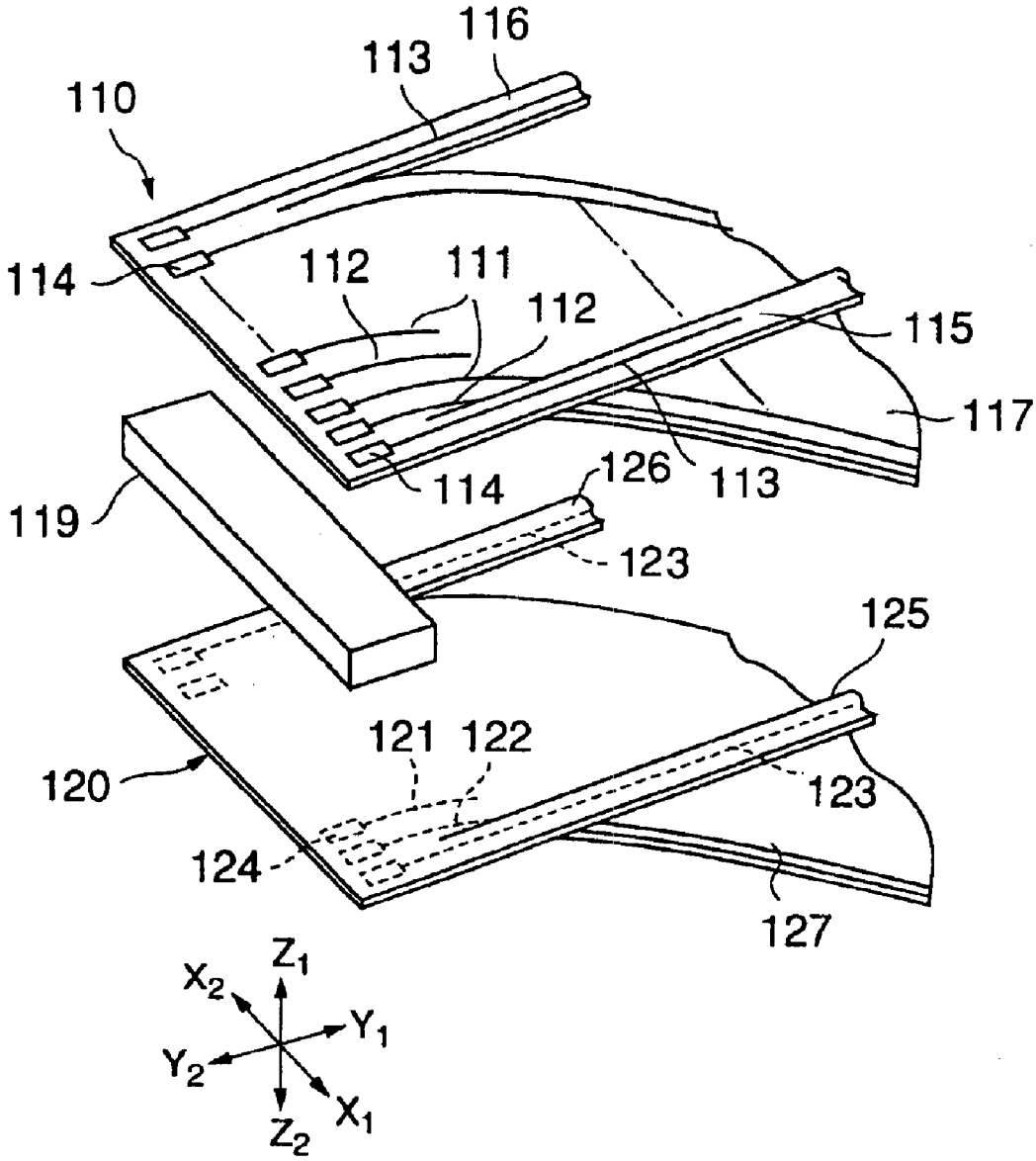
FIG. 7 is a schematic diagram showing flexible cables used in the plug connector according to the first embodiment of the present invention.

Referring to FIG. 7, the flexible cable 110 has signal lines 111 and ground lines 112 arranged alternately along the X-axis between power supply lines 113. Pads 114 defining the ends of the corresponding lines 111 through 113 are aligned on the $Y_2$-side end of the flexible cable 110 along the X-axis. Further slits are formed on the $X_1$ and $X_2$ sides in the flexible cable 110 so as to separate belt-like parts 115 and 116 including the power supply lines 113 from a part 117 in which the signal lines 111 and the ground lines 112 are formed.

The flexible cable 120, which is an upside-down version of the flexible cable 110, includes signal lines 121, ground lines 122, and power supply lines 123, pads 124, parts 125, 126, and 127. The flexible cable 110 has the characteristic impedance of the signal lines 111 with respect to differential signals set to 100 Ω. The flexible cable 120 has the characteristic impedance of the signal lines 121 with respect to differential signals set to 100 Ω.

Referring to FIGS. 5 and 7, the $Y_2$-side ends of the flexible cables 110 and 120 are inserted between the fork-like mounting terminal parts 73*a* of the ground contact members 73, between fork-like mounting terminal parts 74*a* of the power supply contact members 74, and between the opposing mounting terminal parts 72-1*a* and 72-2*a* of the first and second signal contact members 72-1 and 72-2 with a spacer 119 being interposed between the $Y_2$-side ends of the flexible cables 110 and 120. Referring to FIG. 5, the $Y_1$-side ends of the flexible cables 110 and 120 are connected to the connector 85.

Each of the flexible cables 110 and 120 is bent like a crank. The flexible cables 110 and 120 are in contact with the guide projections 61*b* and 61*c*, respectively. As a result, the flexible cables 110 and 120 are bent like a crank to be parallel to each other in an orderly fashion in a narrow space. Accordingly, the coupling of "+" and "−" signals is maintained while the signals are transmitted through the flexible cables 110 and 120.

The belt-like parts 115 and 116 are separated from the center part 117, and the belt-like parts 125 and 126 are separated from the center part 127, so that the power supply lines 113 are apart from the signal lines 111 and the ground lines 112, and the power supply lines 123 are apart from the signal lines 121 and the ground lines 122. As a result, power supply is prevented from affecting signal transmission.

The connector 50 having the above-described configuration is used with an end of the optical fiber cable 150 being connected to the optical fiber cable connector part 52 as shown in FIG. 3.

The paired "+" and "−" signals received by the connector main body 70 are converted into light signals by the photoelectric conversion module 90 so that "+" and "−" light signals are transmitted to the optical fiber cable 150. On the other hand, "+" and "−" light signals transmitted through the optical fiber cable 150 are converted into electrical signals by the photoelectric conversion module 90 to be transmitted from the connector main body 70.

Figure 8:
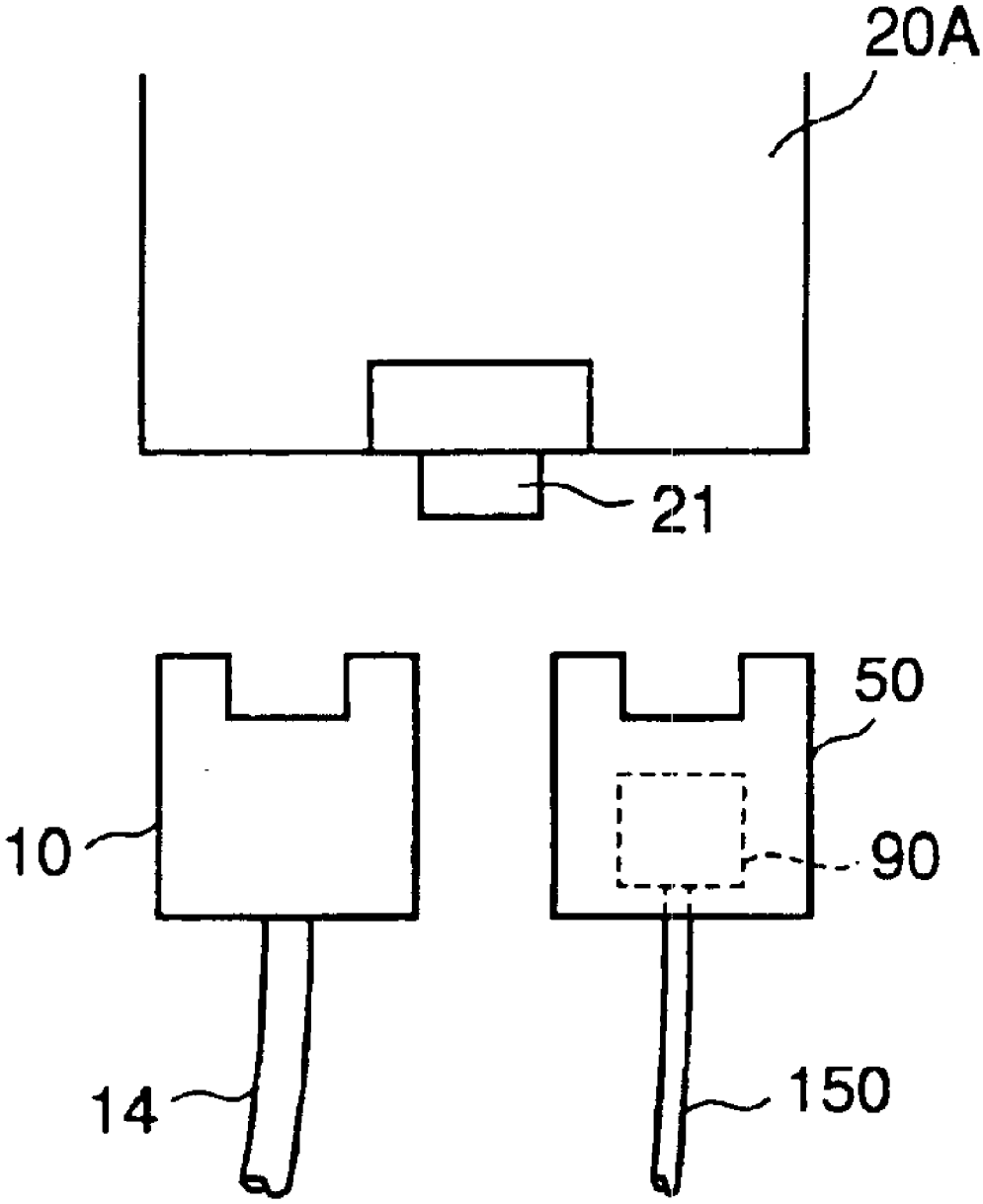
FIG. 8 is a schematic diagram showing the relationship between a server apparatus and the plug connector according to the first embodiment of the present invention.

When the connector 50 of the above-described configuration is available, a server apparatus 20A may be configured to have the differential transmission jack connector 21 on its rear side as shown in FIG. 8. This is because it is possible to use the conventional differential transmission plug connector 10 of FIG. 1 and the differential transmission plug connector 50 of FIG. 3 for different purposes. That is, if the server apparatus 20A is disposed close to a computer, the server apparatus 20A and the computer may be connected with the electric wire cable 14, using the conventional plug connector 10 of FIG. 1. On the other hand, if the server apparatus 20A is disposed remote from the computer, the plug connector 50 of FIG. 3 may be used to be inserted into and connected to the jack connector 21, thereby connecting the server apparatus 20A and the computer with the optical fiber cable 150.

Figure 2:
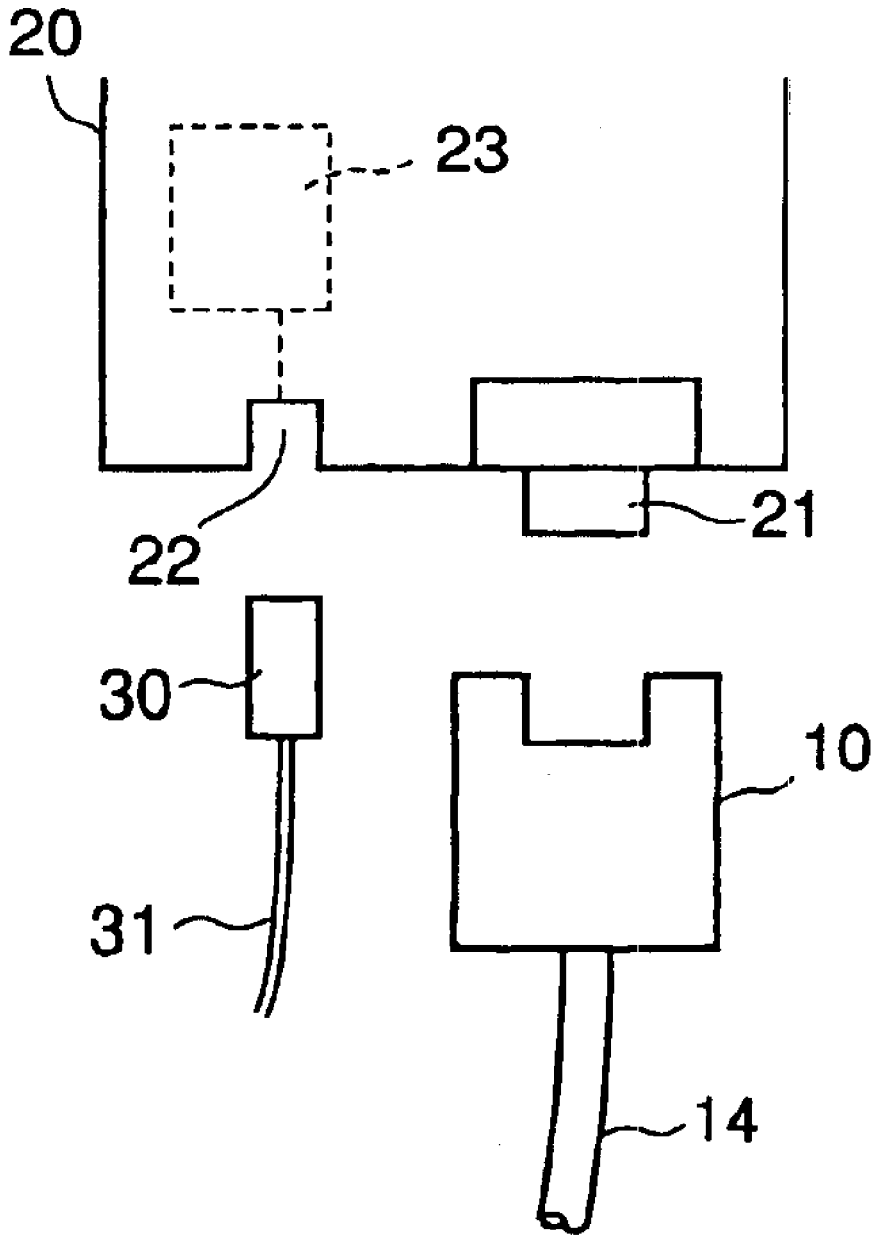
FIG.2 PRIOR ART
FIG. 2 is a schematic diagram showing the relationship between a server apparatus and the conventional plug connector.

Thus, the server apparatus 20A may be configured to have the differential transmission jack connector 21 on its rear side as shown in FIG. 8. Accordingly, the server apparatus 20A is reduced in production cost compared with the conventional server apparatus 20 shown in FIG. 2.

Figure 9:
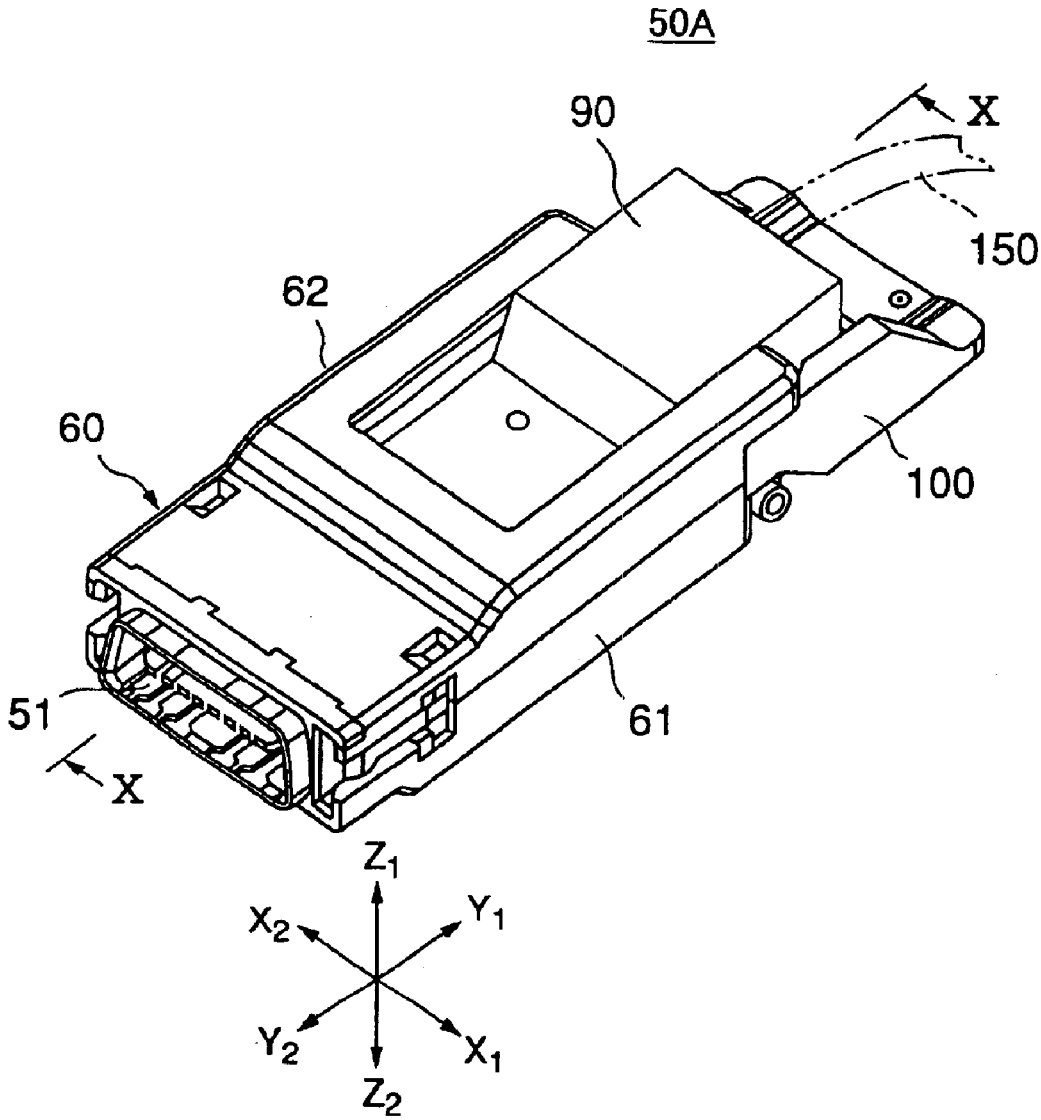
FIG. 9 is a perspective view of a plug connector for differential transmission in an upside down position according to a second embodiment of the present invention.
Figure 10:
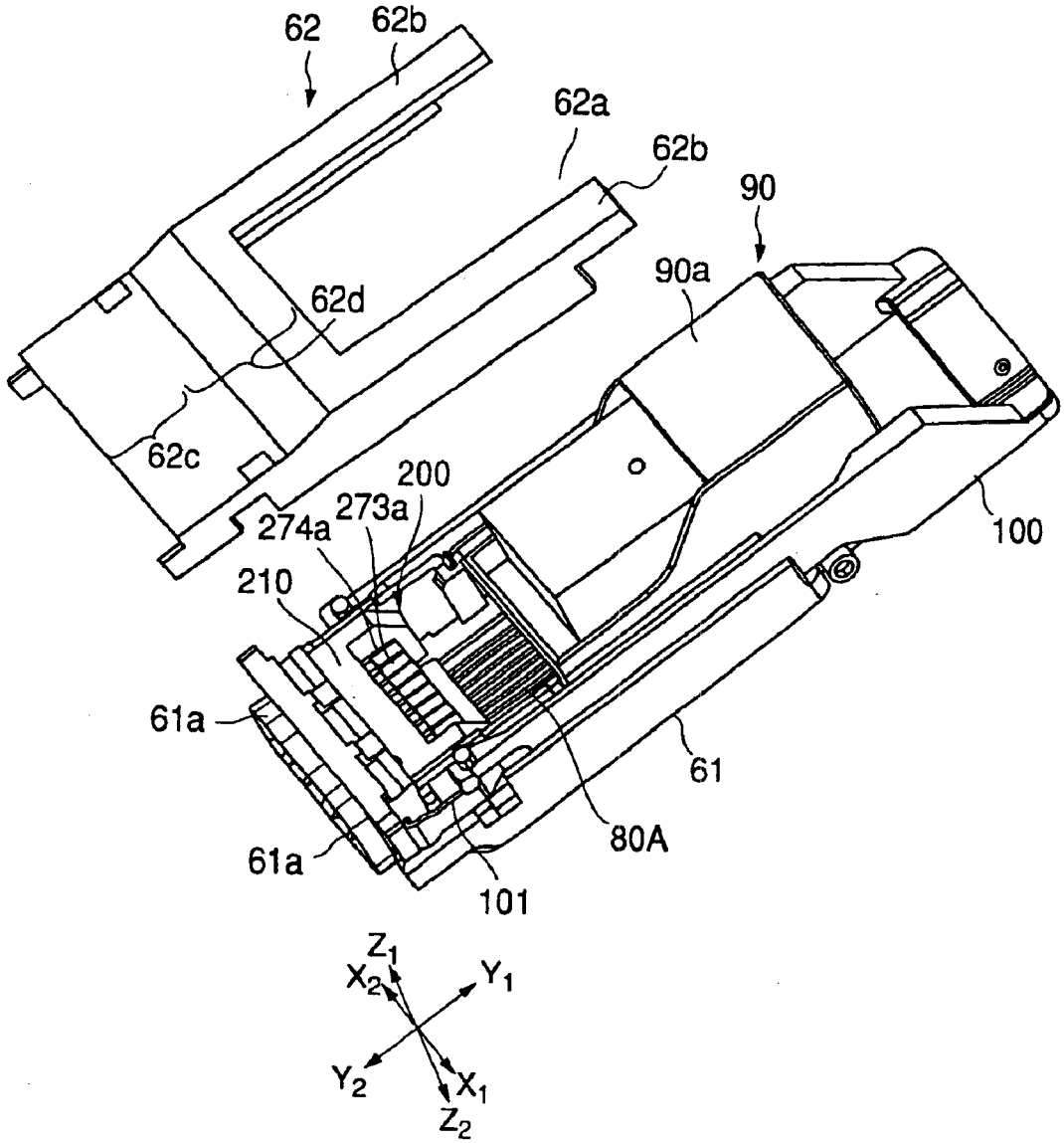
FIG. 10 is a partially exploded view of the plug connector of FIG. 9 according to the second embodiment of the present invention.
Figure 11:
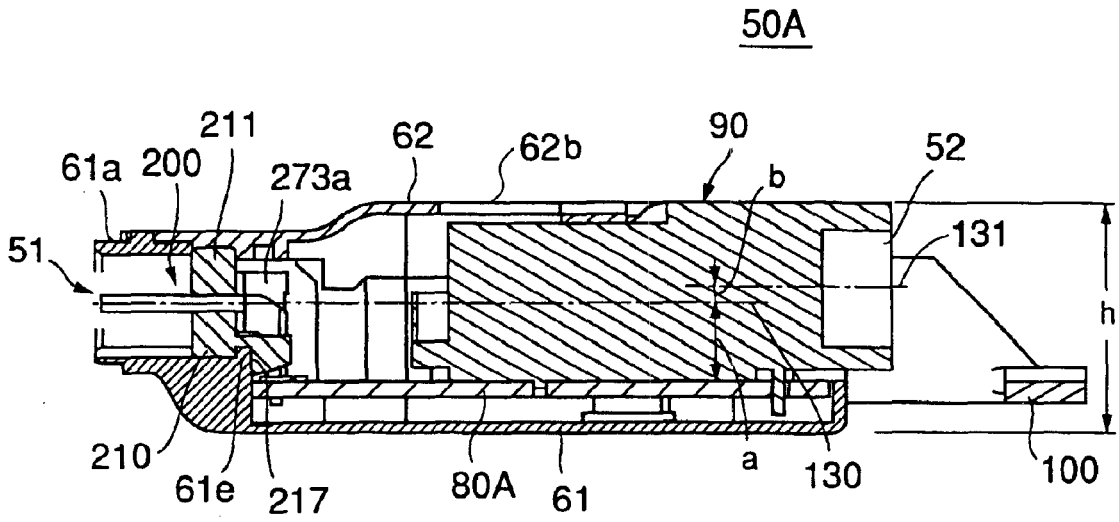
FIG. 11 is a sectional view of the plug connector of FIG. 9 taken along the line X—X according to the second embodiment of the present invention.

FIGS. 9, 10, and 11 are diagrams showing a cable-type plug connector for differential transmission 50A according to a second embodiment of the present invention. In the second embodiment, the same elements as those of the first embodiment are referred to by the same numerals, and a description thereof is omitted. In order to accommodate the distance a, the connector 50A employs a differential transmission plug connector main body 200 of a right-angle and surface-mounting type instead of the connector main body 70, thereby dispensing with the flexible cables 110 and 120.

Referring to FIGS. 9 through 11, the connector 50A has the housing 60, the connector main body 200, a rigid printed circuit board 80A, and the photoelectric conversion module 90 incorporated in the housing 60. The connector 50A further includes the pull tab 100 projecting in the $Y_1$ direction from the housing 60. The printed circuit board 80A extends longer in the $Y_2$ direction than the printed circuit board 80 shown in FIG. 5. The height h of the connector 50A is substantially equal to that of the connector 50. The electric connection between the connector main body 200 and the printed circuit board BOA between which exists the vertical distance a is achieved by the connector main body 200 itself, which is of a right-angle type to accommodate the distance a. The $Y_2$-side parts 62*c* and 62*d* of the upper housing member 62 cover the space above the connector main body 200 and part of the printed circuit board 80A. The printed circuit board 80A has the characteristic impedance of signal lines with respect to differential signals set to 100 Ω.

Next, a description is given, with reference to FIGS. 12 through 15C, of the connector main body 200.

Figure 14:
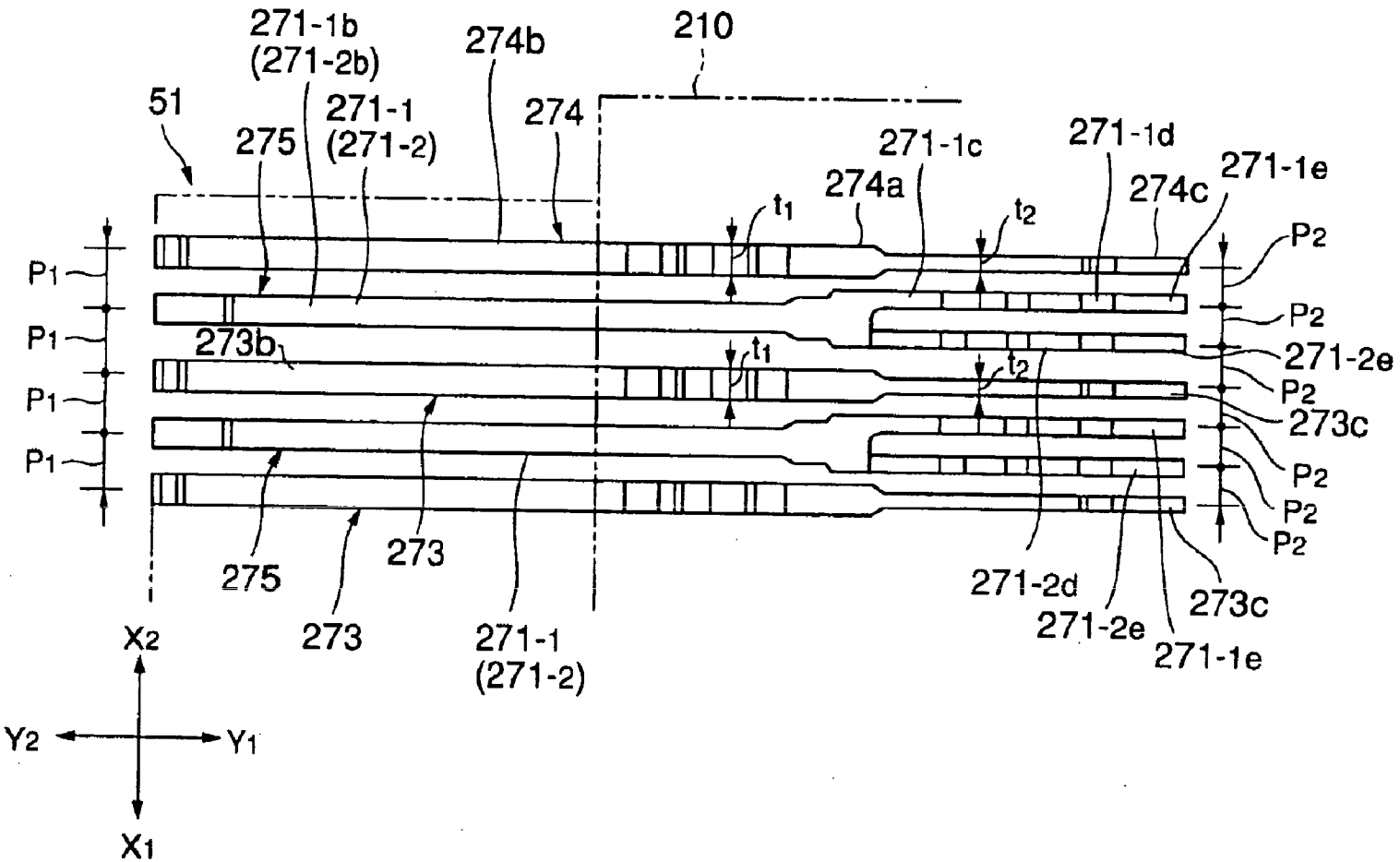
FIG. 14 is a schematic diagram showing an arrangement of contact members of the connector main body according to the second embodiment of the present invention.

The connector main body 200 includes a block body 210, which is an electrically insulating molded component of a synthetic resin. Signal contact pairs 275 of first and second signal contact members 271-1 and 271-2, plate-like ground contact members 273, and plate-like power supply contact members 274 are incorporated into the block body 2100. Referring to FIG. 14, the first and second signal contact members 272-1 and 272-2 (signal contact pairs 275) and the ground contact members 273 are arranged alternately along the X-axis between the power supply contact members 274, defining the $X_1$- and $X_2$-side ends of the arrangement, at the same pitch $P_1$. Each of the first and second signal contact members 271-1 and 271-2 is positioned, for its length, between the adjacent ground contact members 273.

Figure 12:
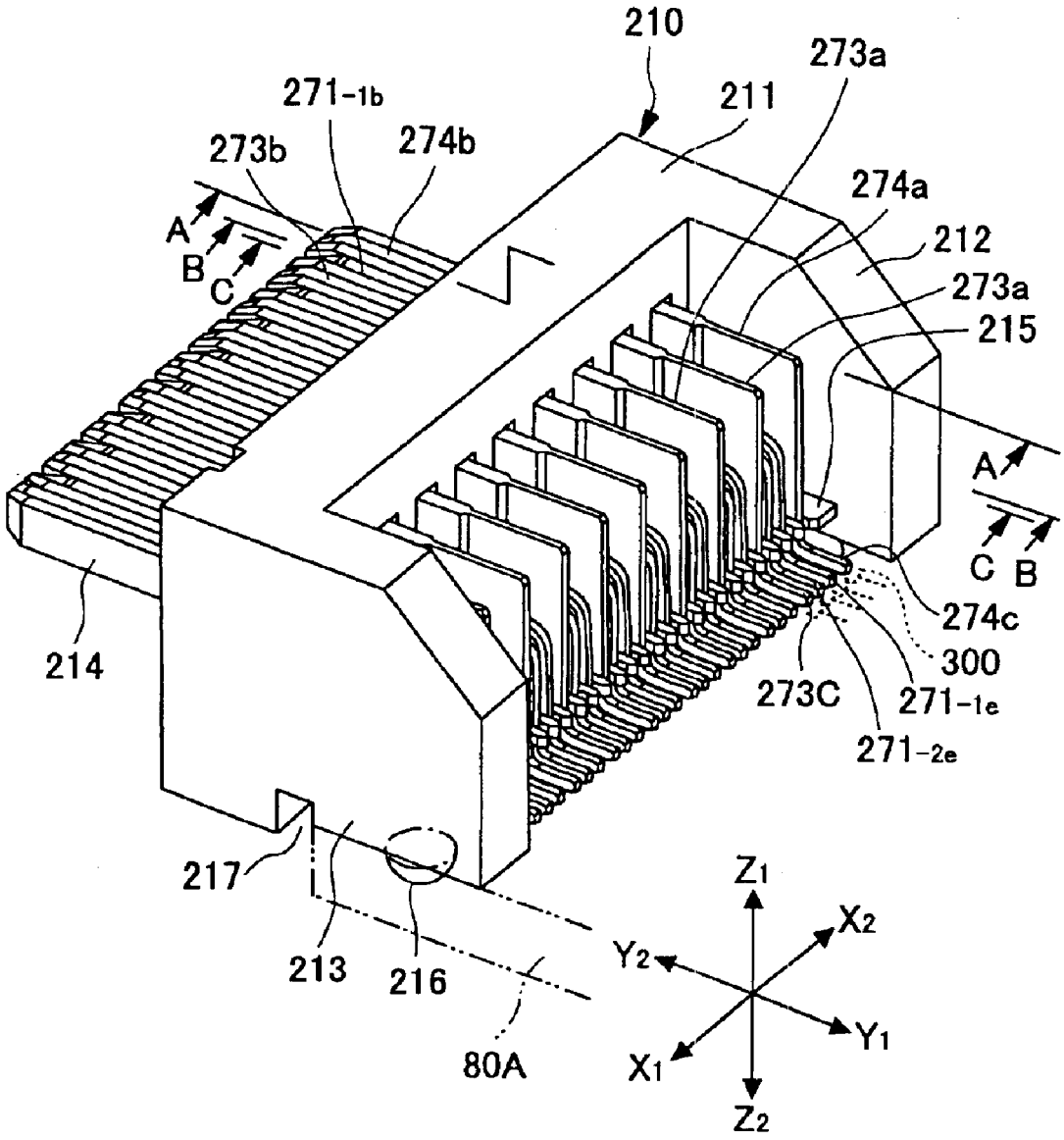
FIG. 12 is a perspective view of a connector main body of a right-angle type of the plug connector according to the second embodiment of the present invention.
Figure 13:
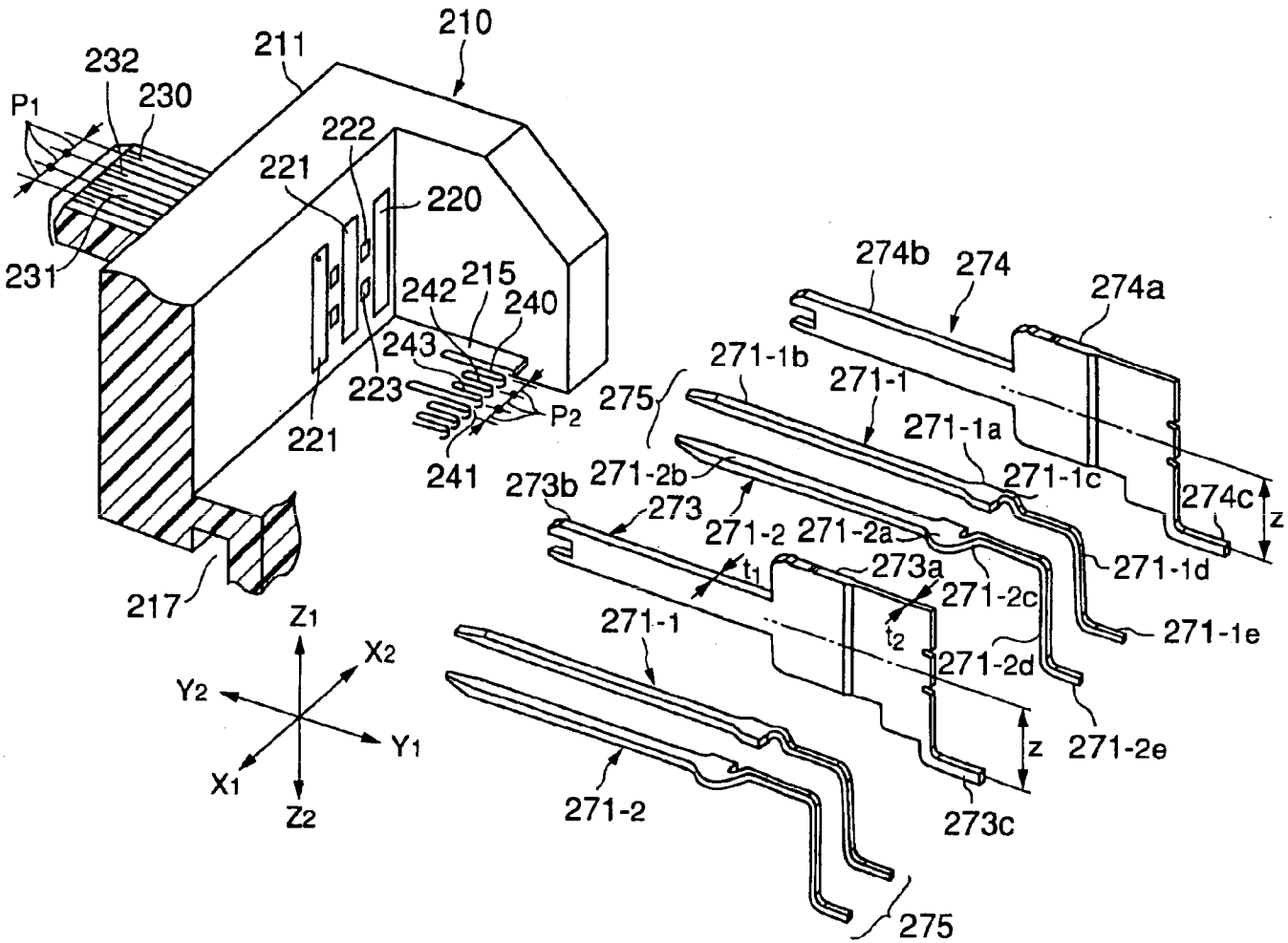
FIG. 13 is an exploded perspective view of part of the connector main body according to the second embodiment of the present invention.

Referring to FIGS. 12 and 13, the block body 210 includes a main body part 211, support parts 212 and 213 extending in the $Y_1$ direction from the $X_2$ and $X_1$ ends, respectively, of the main body part 211, a plate-like projection part 214 projecting in the $Y_2$ direction from the main body part 211, a position control part 215 projecting from the main body part 211 to take up the space between the support parts 212 and 213, and boss parts 216 provided on the lower sides of the support parts 212 and 213.

Slits 220 for the power supply contact members 274, slits 221 for the ground contact members 273, and tunnels 222 and 223 for the first and second signal contact members 271-1 and 271-2, respectively, are formed in the main body part 211 at the same pitch $P_1$. Slits 230, which are the extensions of the slits 220, slits 231, which are the extensions of the slits 221, grooves 232, which are the extensions of the tunnels 222, and grooves 233 (FIGS. 15B and 15C), which are the extensions of the tunnels 223 are formed in the projection part 214. The grooves 232 and 233 are formed on the $Z_1$- and $Z_2$-side faces, respectively, of the projection part 214.

Slits 240, 242, 243, and 241 are formed in the $Y_1$ edge of the position control part 215. The deep slits 240 and 241 are formed at positions corresponding to the slits 220 and 221, respectively. The shallow slits 242 and 243 are formed at such positions as to equally divide each distance between the adjacent slits 241 or 240 and 241. The slits 240, 242, 243, and 241 are arranged at the same pitch $P_2$, which is two-thirds of the pitch $P_1$.

Referring to FIG. 13, each ground contact member 273, which is stamped out from a plate material of, for instance, 0.4 mm in thickness, by a press, includes a base part 273*a*, a ground contact part 273*b* extending in the $Y_2$ direction from the base part 273*a*, and an L-shaped mounting terminal part 273*c* extending in the $Y_1$ direction from the base part 273*a*. The $Y_2$-side half portion of the base part 273*a* and the ground contact part 273*b* are $t_1$ in thickness. The $Y_1$-side half portion of the base part 273*a* and the mounting terminal part 273*c* are struck to be thinned by a press so as to be $t_2$, for instance, 0.2 mm, in thickness. The mounting terminal part 273*c* is biased (offset) in the $Z_2$ direction by a dimension z relative to the ground contact part 273*b*.

The power supply contact members 274 are equal in configuration to the ground contact members 273. Each power supply contact member 274 includes a base part 274*a*, a power supply contact part 274*b*, and a mounting terminal part 274*c*. The mounting terminal part 274*c* is biased (offset) in the $Z_2$ direction by the dimension z relative to the power supply contact part 274*b*.

Each first signal contact member 271-1 includes a base part 271-1*a*, a rod-like signal contact part 271-1*b* projecting in the $Y_2$ direction from the base part 271-1*a*, a length adjustment part 271-1*c* extending obliquely downward from an $X_2$-side portion of the base part 271-1*a*, an extension part 271-1*d* extending in a substantially inverse L-shape from the length adjustment part 271-1*c*, and a mounting terminal part 271-1*e* extending in the $Y_1$ direction from the end of the extension part 271-1*d*.

Each second signal contact member 271-2 includes a base part 271-2*a*, a rod-like signal contact part 271-2*b* projecting in the $Y_2$ direction from the base part 271-2*a*, a length adjustment part 271-2*c* extending obliquely upward from an $X_1$-side portion of the base part 271-2*a*, an extension part 271-2*d* extending in a substantially inverse L-shape from the length adjustment part 271-2*c*, and a mounting terminal part 271-2*e* extending in the $Y_1$ direction from the end of the extension part 271-2*d*.

Figure 15A:
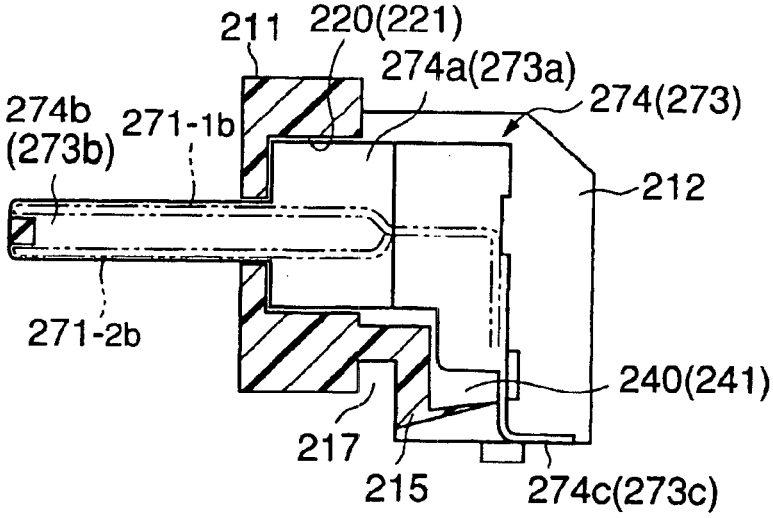
FIGS. 15A through 15C are cross-sectional views of the connector main body of FIG. 12, taken along the lines A—A, B—B, and C—C, respectively, according to the second embodiment of the present invention.
Figure 15B:
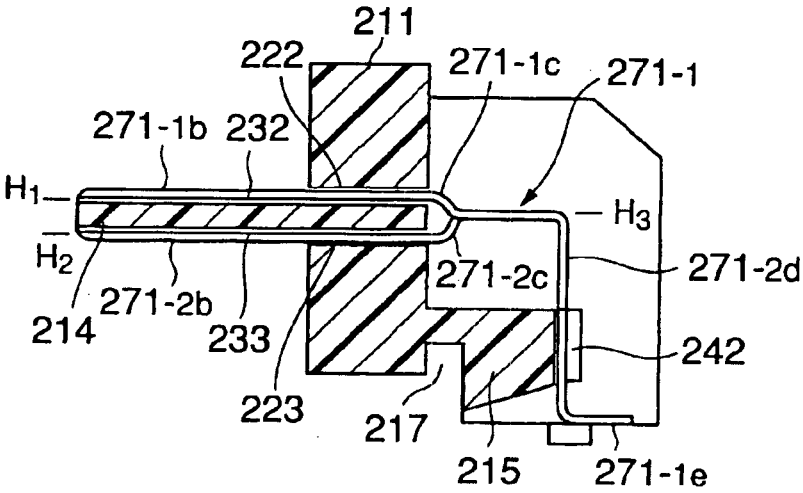
Figure 15C:
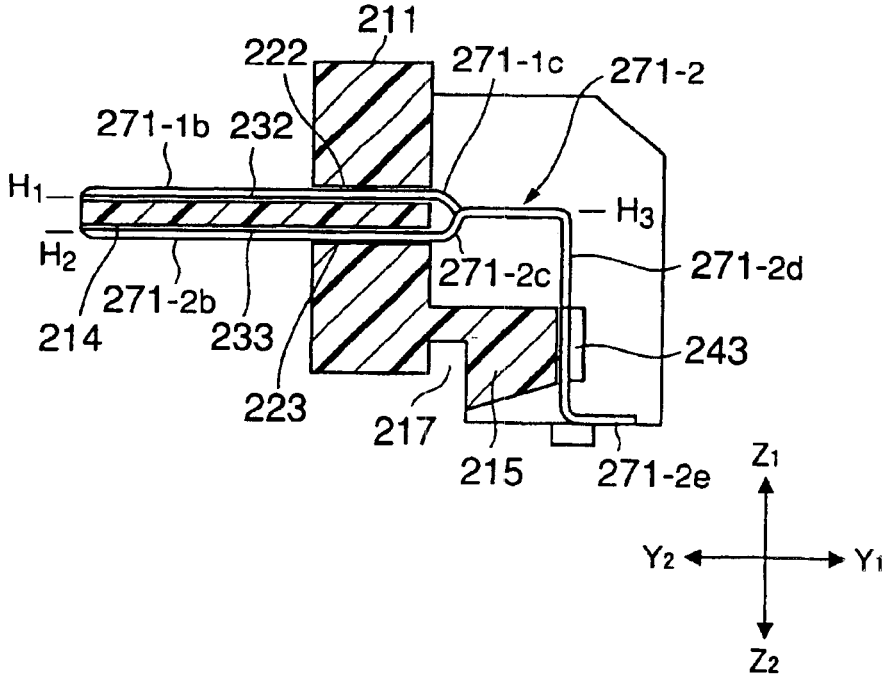

FIGS. 15A through 15C are cross-sectional views of the connector main body 50A shown in FIG. 12, taken along the lines A—A, B—B, and C—C, respectively. Referring to FIGS. 15A through 15C, the power supply contact members 274, the ground contact members 273, and the first and second signal contact members 271-1 and 271-2 are press-fitted into the slits 220, slits 221, tunnels 222, and tunnels 223, respectively, from the $Y_1$ side of the block body 210 so as to be fixed thereto. The power supply contact parts 274*b*, the ground contact parts 273*b*, the signal contact parts 271-1*b*, and the signal contact parts 271-2*b* are fitted into the slits 230, the slits 231, the grooves 232, and the grooves 233, respectively. Each signal contact part 271-1*b* and each signal contact part 271-2*b* are positioned at a height H1 and a height H2, respectively. The height H3 of each of the length adjustment parts 271-1*c* and 271-2*c* at its $Y_1$-side end is intermediate between H1 and H2. Here, the word "height" refers to the (vertical) distance from the X-Y plane defining the bottom face of the block body 210.

A $Y_1$-side end portion of the base part 274*a* of each power supply contact member 274 is fitted into the corresponding slit 240. A $Y_1$-side end portion of the base part 273*a* of each ground contact member 273 is fitted into the corresponding slit 241. The extension part 271-1*d* of each first signal contact member 271-1 is fitted into the corresponding slit 242. The extension part 271-2*d* of each first signal contact member 271-2 is fitted into the corresponding slit 243. The positions of the mounting terminal parts 273*c*, 274*c*, 271-1*e*, and 271-2*e* are controlled along the X-axis by the position control part 215. The paired mounting terminal parts 271-1*e* and 271-2*e* (signal contact pairs 275) are disposed between the adjacent mounting terminal parts 273*c* and 274*c* or the adjacent mounting terminal parts 273*c*. Further, the mounting terminal parts 273*c*, 274*c*, 271-1*e*, and 271-2*e* are aligned on the same X-Y plane defining the bottom face of the block body 210.

Referring to FIG. 11, the connector main body 200 having the above-described structure is incorporated in the connector 50A, being fixed immovably thereto, with the main body part 211 of the block body 210 being held between the lower and upper housing members 61 and 62 and a recess 217 provided to the lower face of the block body 210 being fitted to a convex part 61*e* of the lower housing member 61. The projection part 214 projects in the center of the frame part 61*a* to form the electric plug part 51. Referring to FIG. 12, the connector main body 200 is provided on the printed circuit board 80A by surface mounting so that the mounting terminal parts 271-1*e*, 271-2*e*, 273*c*, and 274*c* are mounted on the surface of the printed circuit board 80A to be soldered to corresponding pads 300 (indicated by broken lines) arranged along the X-axis on the $Y_2$-side end of the printed circuit board 80A.

Like the connector 50A of FIG. 3, the connector 50A having the above-described configuration is used with an end of the optical fiber cable 150 being connected to the optical fiber cable connector part 52. The connector 50A operates in the same way and produces the same effects as the connector 50.

That is, the paired "+" and "−" signals received by the connector main body 200 are converted into light signals by the photoelectric conversion module 90 so that "+" and "−" light signals are transmitted to the optical fiber cable 150. On the other hand, "+" and "−" light signals transmitted through the optical fiber cable 150 are converted into electrical signals by the photoelectric conversion module 90 to be transmitted from the connector main body 200.

When the connector 50A of the above-described configuration is available, the server apparatus 20A may be configured to have the differential transmission jack connector 21 on its rear side as shown in FIG. 8. This is because it is possible to use the conventional differential transmission plug connector 10 of FIG. 1 and the differential transmission plug connector 50A of FIG. 9 for different purposes. Thus, the server apparatus 20A may be configured to have the differential transmission jack connector 21 on its rear side as shown in FIG. 8. Accordingly, the server apparatus 20A is reduced in production cost compared with the conventional server apparatus 20 shown in FIG. 2.

Further, according to the second embodiment, the employment of the differential transmission plug connector main body 200 of a right-angle and surface-mounting type eliminates the necessity of connecting flexible cables to a connector and bending the flexible cables so that the flexible cables form a predetermined transmission path. Accordingly, it is easy to produce the connector 50A.

By replacing the differential transmission plug connector main body 70 or 200 with a differential transmission jack connector main body, a differential transmission jack connector including the differential transmission jack connector main body and the photoelectric conversion module 90 may be formed.

The present invention is not limited to the specifically disclosed embodiments, and variations and modifications may be made without departing from the scope of the present invention.

The present application is based on Japanese priority patent application No. 2003-150600, filed on May 28, 2003, the entire contents of which are hereby incorporated by reference.

What is claimed is:

1. A connector for differential transmission, comprising:

a connector housing;

a connector main body attached to the connector housing, the connector main body including a differential transmission electric connector part connectable to a connector of an apparatus, the differential transmission electric connector part having a plurality of signal contact pairs and a plurality of ground contact members arranged alternately, the signal contact pairs each including first and second signal contact members; and a photoelectric conversion module provided to the connector housing to be electrically connected to the connector main body, the photoelectric conversion module including a photoelectric conversion part and an optical fiber cable connector part to which an optical fiber cable is connectable, wherein the differential transmission electric connector part of the connector main body is provided to a first end of the connector housing, and the optical fiber cable connector part of the photoelectric conversion module is provided to a second end of the connector housing, the second end being opposite to the first end.

2. The connector as claimed in claim 1, wherein the connector main body has power supply contact members so that the signal contact pairs and the ground contact members are arranged alternately between the power supply contact members.

3. A connector for differential transmission, comprising:

a connector housing;

a connector main body provided to the connector housing, the connector main body including a differential transmission electric connector part connectable to a connector of an apparatus, the differential transmission electric connector part having a plurality of signal contact pairs and a plurality of ground contact members arranged alternately, the signal contact pairs each including first and second signal contact members;

a rigid printed circuit board provided to the connector housing; and a photoelectric conversion module provided to the connector housing, being mounted on the rigid printed circuit board to be electrically connected to the connector main body, the photoelectric conversion module including a photoelectric conversion part and an optical fiber cable connector part to which an optical fiber cable is connectable, wherein the differential transmission electric connector part of the-connector main body is provided to a first end of the connector housing, and the optical fiber cable connector part of the photoelectric conversion module is provided to a second end of the connector housing, the second end being opposite to the first end.

4. The connector as claimed in claim 3, wherein: the rigid printed circuit board and the differential transmission electric connector part of the connector main body are disposed at different levels in a direction perpendicular to a surface of the rigid printed circuit board; and the connector main body and the rigid printed circuit board are electrically connected with flexible cables.

5. The connector as claimed in claim 3, wherein: the rigid printed circuit board and the differential transmission electric connector part of the connector main body are disposed at different levels in a direction perpendicular to a surface of the rigid printed circuit board;

the connector main body is of a right-angle type, having mounting terminal parts thereof positioned at a level different from a level at which the differential transmission electric connector part thereof is positioned in the direction perpendicular to the surface of the rigid printed circuit board; and the connector main body has the mounting terminal parts thereof soldered to the rigid printed circuit board.

6. The connector as claimed in claim 3, wherein: the connector housing includes an opening window forming part; and the photoelectric conversion module is fitted to the opening window forming part so that a surface of the photoelectric conversion module forms part of an outer form of the connector.

7. The connector as claimed in claim 3, wherein the connector main body has power supply contact members so that the signal contact pairs and the ground contact members are arranged alternately between the power supply contact members.

* * * * *

UNITED STATES PATENT AND TRADEMARK OFFICE

CERTIFICATE OF CORRECTION

PATENT NO. : 6,887,101 B2
DATED : May 3, 2005
INVENTOR(S) : Takeshi Ito et al.

It is certified that error appears in the above-identified patent and that said Letters Patent is hereby corrected as shown below:

Column 11,
Line 13, change “the-connector” to -- the connector --.

Signed and Sealed this

Tenth Day of January, 2006

JON W. DUDAS
*Director of the United States Patent and Trademark Office*